US006048237A

United States Patent [19]

Hopper

[11] Patent Number: 6,048,237

[45] Date of Patent: Apr. 11, 2000

[54] HYDRODYNAMIC FOIL ANGLE OF INCIDENCE CONTROL SYSTEM

[76] Inventor: William J. Hopper, 1270 N. Marine Dr. Suite 101-233, Tamuning, Guam 96911

[21] Appl. No.: 09/076,161

[22] Filed: May 12, 1998

Related U.S. Application Data

[63] Continuation-in-part of application No. 08/708,926, Sep. 6, 1996, Pat. No. 5,749,759.

[51] Int. Cl.[7] ..... A63B 31/12

[52] U.S. Cl. ..... 441/60

[58] Field of Search ..... 441/60–64, 55; 440/14, 15; D21/239

[56] References Cited

U.S. PATENT DOCUMENTS 3,078,482 2/1963 Crowder ..... 441/60

5,749,759 5/1998 Hopper ..... 441/60

*Primary Examiner*—Ed Swinehart

*Attorney, Agent, or Firm*—Malloy & Malloy, P.A.

[57] ABSTRACT

An apparatus attachable to the legs of a swimmer and structured to aid the swimmer by facilitating the generation of increased thrust as the swimmer moves through the swimming stroke, wherein the apparatus includes a primary foil movable relative to the swimmer's leg and automatically positionable at a predetermined, substantively optimum angle of incidence relative to the direction of relative water flow to the apparatus during movement of the swimmer. An attitude control assembly is maintained in alignment with the direction of relative water flow and is cooperatively structured with the primary foil so as to maintain the primary foil in the predetermined, optimum angle of incidence which facilitates the generation of maximum thrust during the entire swimming stroke.

35 Claims, 10 Drawing Sheets

HYDRODYNAMIC FOIL ANGLE OF INCIDENCE CONTROL SYSTEM

BACKGROUND OF THE INVENTION

This is a continuation-in-part application of application Ser. No. 08/708,926 filed on Sep. 6, 1996 to issue into U.S. Pat. No. 5,749,759 on May 11, 1998.

FIELD OF THE INVENTION

This invention relates to an apparatus attachable to the legs of a swimmer for aiding in the maintenance of optimum thrust during the entire swimming stroke by including a primary foil automatically positionable at a substantially optimum angle of incidence relative to a direction of relative water flow to the apparatus as the legs of the swimmer perform a complete conventional swimming stroke, thereby increasing the duration of an optimum thrust generating profile.

DESCRIPTION OF THE RELATED ART

Simple swimming aid devices designed for the aid of swimming and structured to be worn on the lower leg or foot of the swimmer are known to employ a semi-flexible swim member or "swim fin" having an enlarged "bluff" surface that generally attaches to the foot for increasing the effective surface area of the foot. The structural design of such relatively simple, known devices is based on the idea of increasing the quantity of water to which a simmer can impart backward kinetic energy and thereby achieve forward propulsion in a desired swim direction. The swim member or swim fin moves substantially with the foot so that the enlarged, bluff surface is oriented by the foot against the swim direction, during a leg's thrust stroke, and along the swim direction, during a return stroke.

More complex devices designed to aid a swimmer during the swimming stroke and mountable on the swimmer's legs or feet typically employ a swim member including a body having an enlarged bluff surface wherein the body is hindgedly attached to the swim member and rotates under the forces induced by the swimming stroke to present the bluff surface to the swim direction during the leg's thrust stroke and retract or orient the bluff surface during the leg's return leg stroke. These more complex devices appear to employ the same basic concept or principle as due the aforementioned more simplified structural versions set forth above.

Additional, even more complex devices include an enlarged swim fin type of body generally attached to the foot and including a plurality of blades or "finlets" which are pivotal or otherwise movable relative to the body of the swim fin and automatically adjustable during the swimming stroke as the legs of the swimmer are moved repeatedly between the thrust stroke and the return stroke. Modifications of these more complex structures also include one or more fins or blades attached to the leg of the swimmer in spaced relation to the main body of the swim fin mounted on the foot of the swimmer wherein the thrust producing blades are movably attached to the ankle, calf or even upper portion of the leg of the swimmer and extend latterly outward therefrom. Regardless of the structural differences and overall complexity of known devices of the type set forth above, there are primarily two disadvantages generally associated with such known devices. First, such devices have not been found to significantly increase desired swim speeds of a swimmer on a sustained basis. In addition, while such known devices of the type set forth above may be essentially operative for their intended purpose, these known devices may be viewed as having a limited capability for enhancing swimming efficiency. Obviously, in aiding a swimmer to generate additional thrust during the swimming stroke, it is desirable to obtain maximum propulsion while exerting minimum effort. While the aforementioned devices may provide a means for increasing the force of a swimmer can apply to water, during the swimming stroke, it is questionable whether such devices increase the propulsive effectiveness, or swim speed, for a given amount of applied force or swimmer effort.

Another disadvantage of the known devices of the type mentioned above, is the incorporation of a swim member or body having a moment arm with respect to the swimmer's leg or foot so that the force applied to the swim member has a tendency to twist or bend the portion of the body of the swimmer to which they are attached. In addition, such known devices may impose serious bending stresses on the swimmer's ankles, especially during a return stroke during which the swimmer maintains his toes and foot in a generally extended or pointed configuration. In particular, because the movement arm is so far below the ankle, as much as 26 inches in many instances, the load on the ankle is substantial and additional forces on the fin can be detrimental to the ankle if excessive.

In addition to the above, it is well known that conventional swim aids, particularly of the type attached directly to the foot, render walking, in the normal fashion on dry land, extremely difficult if not impossible.

Accordingly, there is a need for an improved, preferred apparatus which specifically aids the swimmer in generating increased thrust during the swimming stroke without requiring, by the swimmer, the exertion of an inordinate effort and/or the expending of excess amounts of energy. Such a preferred swimming aid apparatus should incorporate structure which serves to include a primary hydrofoil extending outwardly from the leg, or other portion of the body to which it is attached, wherein the hydrofoil is automatically adjustable to assume a preferred angle of incidence or angle of attack relative to a direction of water flow over the apparatus. A preferred swimming aid should also maintain the primary hydrofoil in the predetermined, optimum orientation during the swimming stroke of the swimmer, regardless of whether the legs of the swimmer are in an up or down stroke as conventionally preformed.

SUMMARY OF THE INVENTION

The present invention is directed to a swimming aid apparatus attachable to the leg of a swimmer and selectively positionable between an operative position and a stored position. The subject apparatus includes a primary foil which, when in its operative position, extends laterally outward from preferably the ankle of the swimmer to which it is attached. Further, the primary foil is pivotally or rotationally mounted so as to vary its angle of incidence relative to a direction of relative water flow to the apparatus. Alternately, the primary foil may be selectively disposed in the aforementioned stored position generally defined by an aligned, somewhat parallel orientation, immediately adjacent to the length of the leg of the swimmer on which it is mounted. The stored position, of course, facilitates normal walking or travel of the swimmer over land without requiring the removal of the subject apparatus.

An important feature of the present invention is the provision of an attitude control assembly which is operatively interconnected to the primary foil. The attitude control assembly is cooperatively structured with the primary foil to regulate and maintain, on a substantially constant basis, the orientation of the primary foil at what may be considered an optimum angle of incidence or angle of attack relative to the direction of relative water flow passing over the primary foil. This preferred orientation of the primary foil is maintained as the legs of the swimmer travel in a substantially conventional "up and down" movement during the swimming stroke of the swimmer. It is to be emphasized that the structural components incorporated in both the attitude control assembly and those components associated directly with the foil are such as to constantly change and regulate orientation of the primary foil so as to maintain it in a predetermined optimum angle of incidence at least within certain predetermined acceptable parameters. Thus, unlike the previous system which includes an attitude control assembly which in effect incorporates an averaging system for controlling or regulating the angle of attack of a hydrofoil, the present invention is directed to a true constant foil attitude adjustment system. As a result, the attitude of the primary foil is generally maintained at an optimum angle of incidence during the entire swimming stroke, and maintains maximum thrust generating conditions throughout the entire swimming stroke. In particular, without the attitude control assembly, the natural movement of the swimmer's legs during the swimming stroke would reorient the primary foil so that only at certain times during the actual swim stroke will the optimum thrust generating angle be achieved.

The aforementioned attitude control assembly of the present invention therefor is specifically disposed, structured and configured to maintain a constant optimal alignment with the relative direction of water flow as water passes over the primary foil. This is preferably accomplished through the provision of a secondary hydrofoil movable relative to the primary foil and which is designed and configured to automatically maintain an aligned orientation with the direction of relative water flow, while not significantly adding to the generation of thrust as the swimmer moves his legs through the conventional swimming stroke. As such, the secondary foil generally defines a reference to the direction of relative water flow.

The constant regulation of the orientation or attitude of the primary foil is further accomplished through the provision of a foil shroud mounted preferably within the interior of the primary foil and including a hollow interior which at least partially defines a control chamber. The shroud is fixedly secured so as to pivotally rotate with the primary foil relative to a leg cuff or other, equivalent attachment structure serving to mount the apparatus and generally support the primary foil in a preferred location on the leg of the swimmer. A vane assembly is structured for positioning within the control chamber and preferably comprises a plurality of pressure vanes interacting with a plurality of pressure control vanes, wherein the subject vane assembly is structured to define a plurality of variable volume chamber segments within the control chamber.

A flow control assembly including a fluid inlet structure and a fluid outlet structure is disposed in fluid communication with the control chamber and is further interconnected with the attitude control assembly such that the flow of water or fluid into and out of the control chamber is determined by the flow control assembly being either in a closed position or an opened position. The closed or opened positioning of the flow control assembly is in turn determined by the relative orientations of the attitude control assembly and more particularly, the secondary foil associated therewith and the primary foil.

Therefore, it is a principle object of the present invention to provide a novel and improved swim aid apparatus to facilitate the increased generation of thrust during the normal swimming stroke of a swimmer by maintaining an optimal thrust characteristic throughout an entire swimming stroke.

Another primary object of the present invention is to provide a swim aid apparatus that maximizes a swimmer's speed without requiring an inordinate increased effort or expenditure of energy by the swimmer during the conventional swimming stroke.

Yet another important object of the present invention is to provide a swim aid apparatus that minimizes torque reactions about the longitudinal axis of the swimmer's leg to which the subject swim aid apparatus is attached.

Still another important object of the present invention is to provide a swim aid apparatus which is positionable between an operative position, when swimming, and a stored position to allow a swimmer to walk normally on land without requiring the removal of the subject apparatus.

It is yet another object of the present invention to provide a swim aid apparatus incorporating an air foil configuration designed to accomplish the generation of a maximum amount of thrust without the expenditure of additional effort or energy by the swimmer.

It is also an important object of the present invention to provide a swim aid apparatus that controls and regulates the angle of incidence of a foil structure relative to the direction of relative water flow passing over the foil during the movement of the legs on which the subject swim apparatus is mounted as the swimmer continuously performs a substantially conventional swimming stroke.

An added object is to provide a swim aid apparatus which minimizes the stress placed on an ankle of a swimmer, while also increasing the thrust generated by an un-aided swimming stroke.

These and other objects, features and advantages of the present invention will become more clear when the drawing, as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
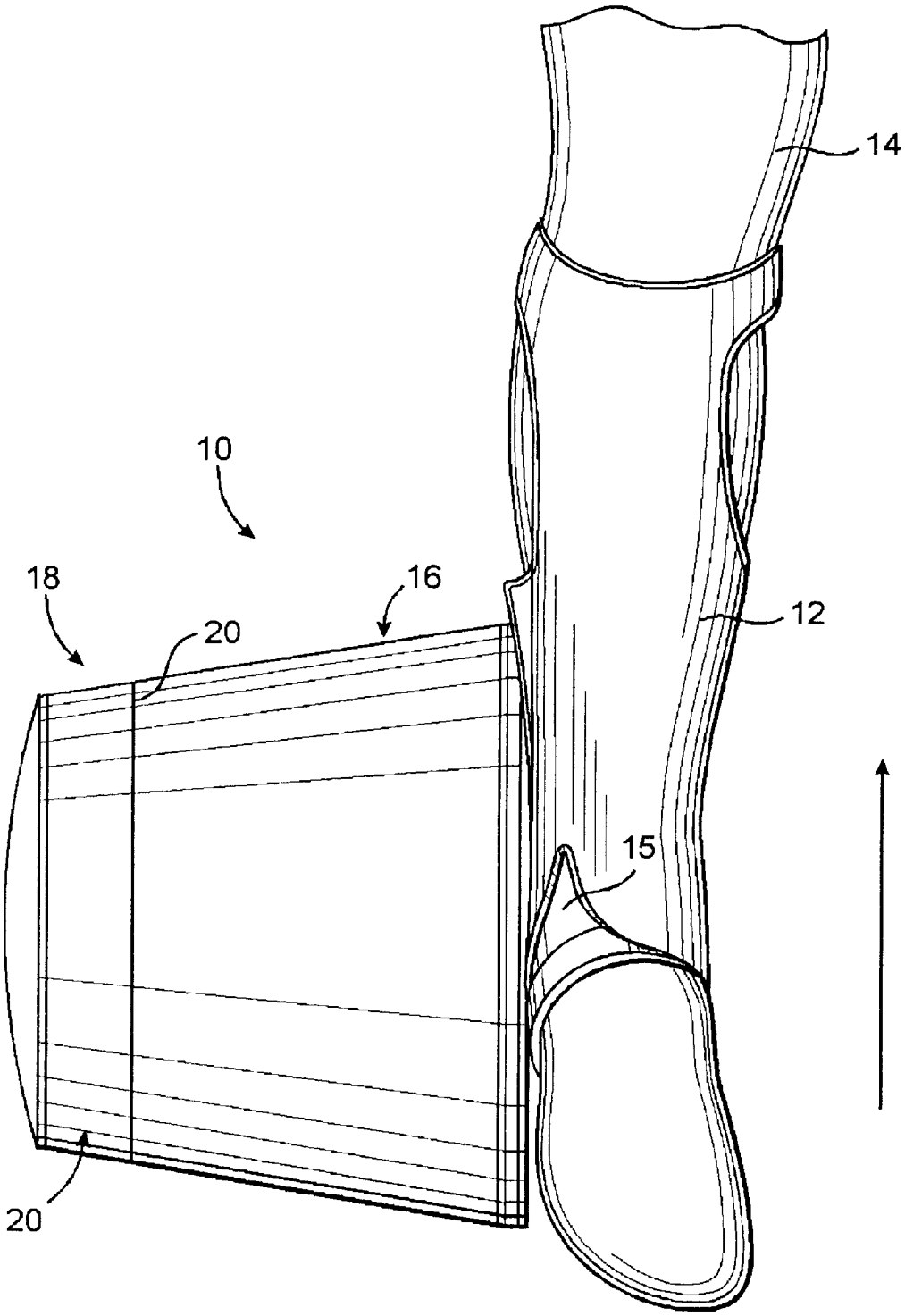
FIG. 1 is a front view in perspective of the apparatus of the present invention mounted on a leg of a swimmer.
Figure 17:
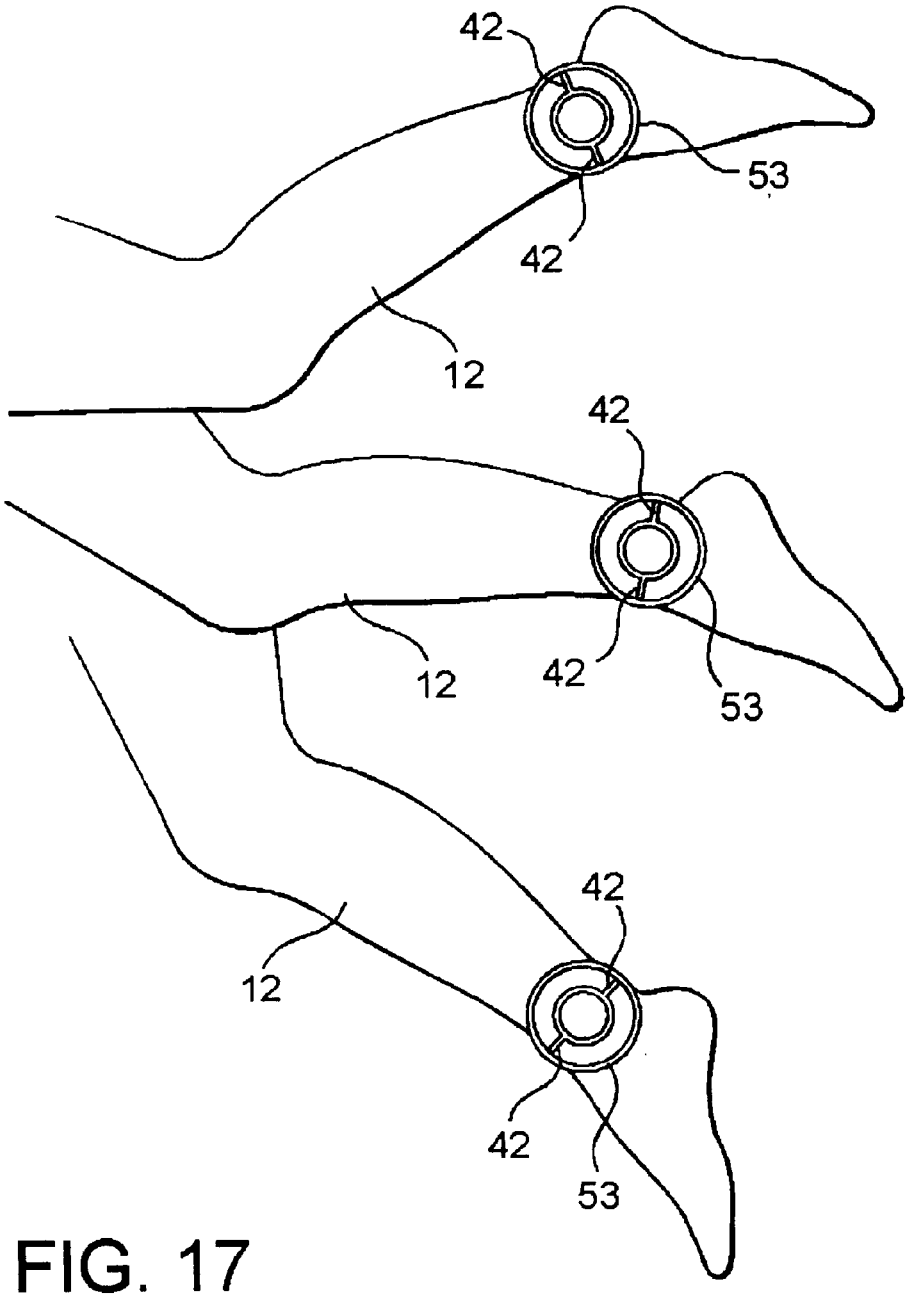
FIG. 17 is a schematic representation of certain structural components of the present invention positioned during a conventional swimming stroke.

As shown in the accompanying Figures, the present invention is directed towards an apparatus to aid swimmers in the generation of increased thrust during the normal swimming stroke within a fluid medium, preferably water, by maintaining an optimum, thrust generating profile throughout an entire swimming stroke. Particularly with regard to FIGS. 1 and 2, the apparatus is generally indicated as 10 and includes an attachment assembly preferably in the form of a cuff 12 designed to be removably secured to the lower portion of each leg 14 of a swimmer. The cuff 12 is designed to be removably attached generally about the ankle area as at 15. Furthermore, extending from, and preferably secured to the cuff 12 are a primary foil generally indicated as 16 and an attitude control assembly generally indicated as 18, the exteriors of which are represented in FIG. 1. As will be described in greater detail hereinafter, the attitude control assembly 18 may includes a secondary foil 20 which is moveable relative to the primary foil 16 generally along a separation joint as at 21. Further, it is emphasized that the configuration of the outer or working surface of the primary foil 16 may take a variety of configurations any one of which is adapted to maximize the generation of thrust at a particular point as the swimmer moves both legs 14 in a conventional swimming stroke, as generally represented in FIG. 17. Similarly, the exterior or working surface of the secondary foil 20 is such as to maintain it in substantially constant alignment with a direction of relative water flow indicated by directional arrow 100 in FIGS. 21–25. It should be understood that the term "direction of relative water flow" is meant to define the flow of water over the primary and secondary foils 16 and 20 of the present invention. Further, the body of water in which the swimmer is travelling may or may not be moving in a direction substantially against the intended direction of the moving swimmer. As such, the relative water flow direction 100 is set forth herein as a reference term indicating the relative direction of water as it flows to the foils 16 and 20, as set forth above, during the swimming movement of the wearer. Typically the relative water flow direction is 180 degrees off from the direction of movement of a mass, such as the axis of the present apparatus, through the water, and indeed, the secondary foil 20 is generally structured to be aligned with the relative water direction so as to provide a reference for the operation of the apparatus. Moreover, once the water flows over the foils 16 and 20, the flow direction thereof will generally conform to the surface of the foil.

Figure 2:
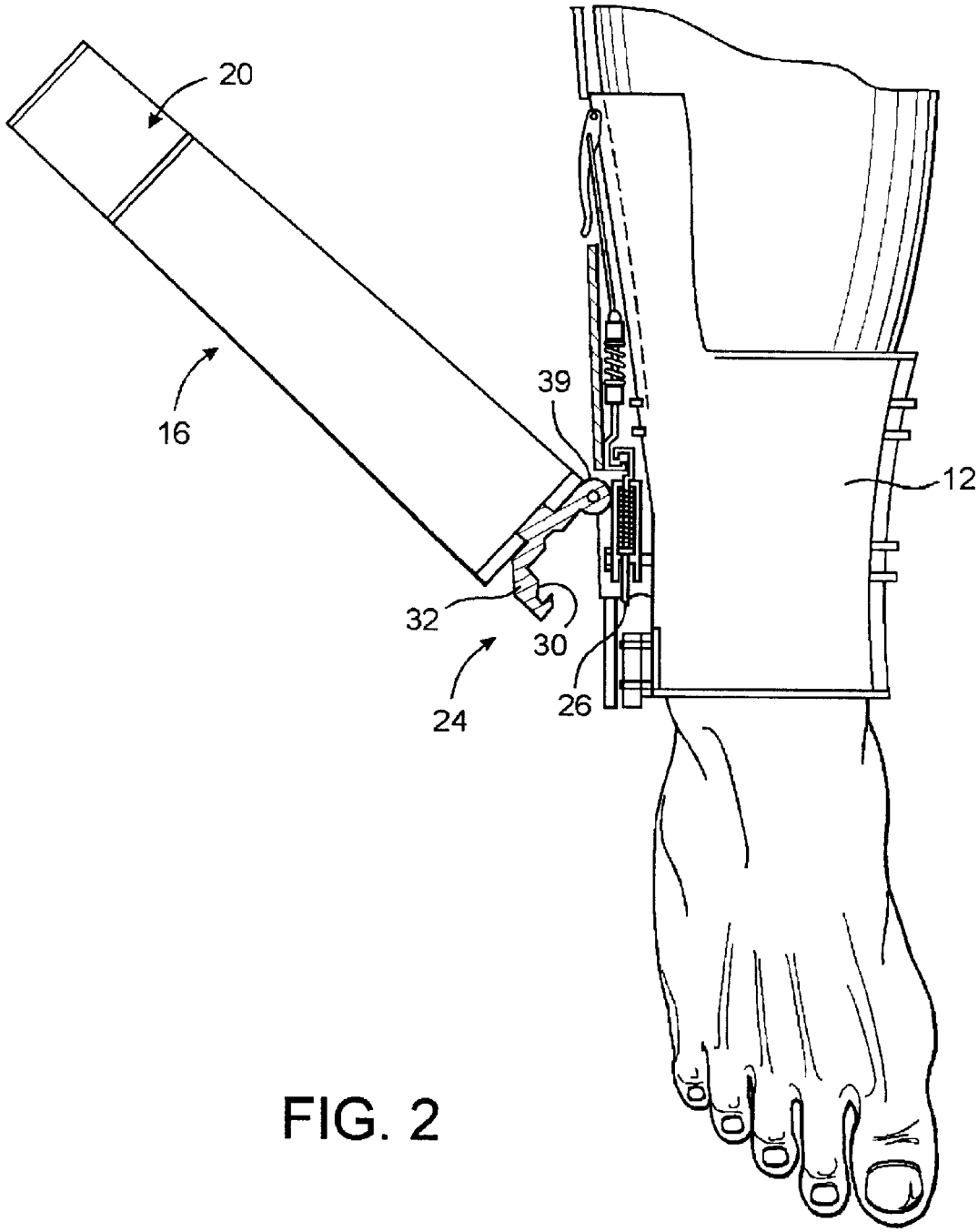
FIG. 2 is a front view in partial cutaway with structural features of the embodiment of FIG. 1 shown in a different position.

Again with reference to FIGS. 1 and 2, the primary foil 16 may be selectively disposed between an operative position and a stored position. The operative position is generally indicated in FIG. 1 wherein the primary foil 16 extends latterly outward from an exterior side of the leg 14 in somewhat of a transverse orientation thereto. When in such an operative position, both the primary foil 16 and the preferred secondary foil 20 are "automatically" oriented in a preferred position relative to the direction of relative water flow 100 as explained in greater detail hereinafter with regard to the embodiment of FIGS. 21 through 25. Alternately, the primary foil 16 may be positioned in a stored position as best shown in FIG. 2 wherein the primary foil 16 is shown being pivoted from its operative position into a substantially aligned, immediately adjacent and at least partially parallel relation to the longitudinal axis of the leg of the swimmer on which it is mounted. Such a stored position greatly facilitates movement of the swimmer out of the water.

Figure 4:
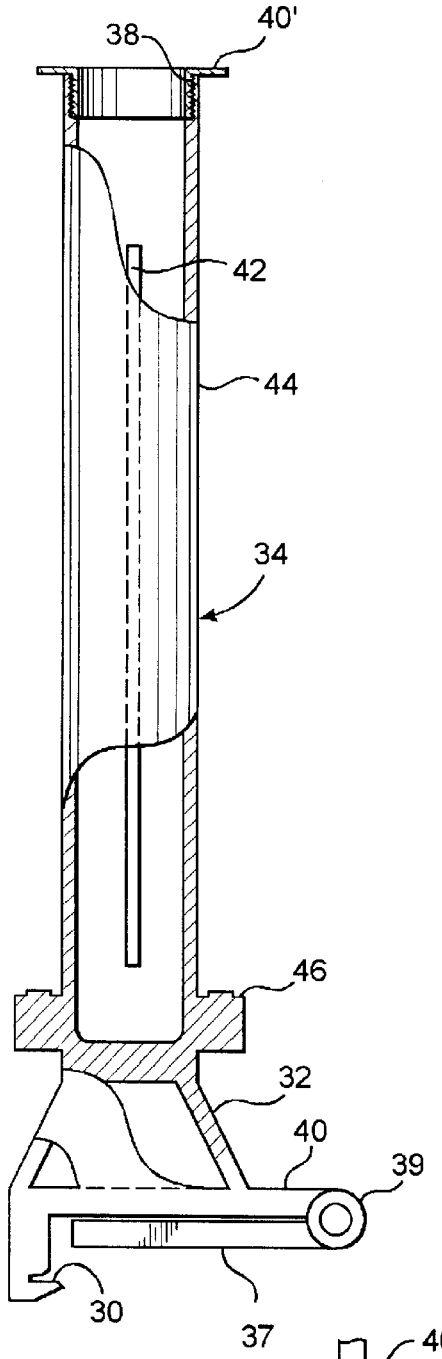
FIG. 4 is a detailed view of certain structural components of the present invention.
Figure 6:
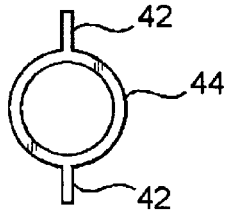
FIG. 6 is a sectional view of certain structure of the embodiment of FIG. 4.
Figure 5:
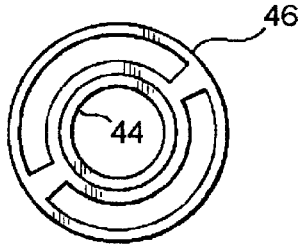
FIG. 5 is an end view of the structure of FIG. 4.
Figure 7:
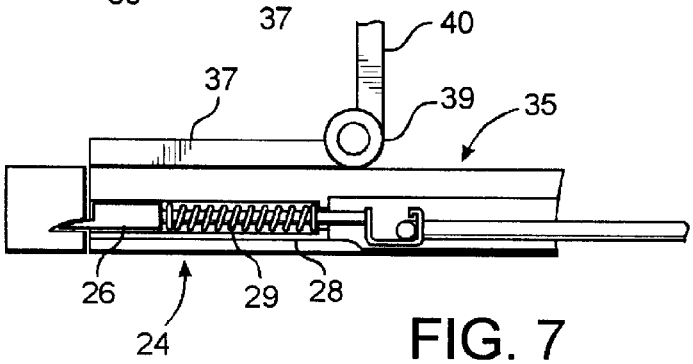
FIG. 7 is a detailed view in partial cutaway of certain components used in cooperation with the structure of the embodiment of FIG. 4.
Figure 12:
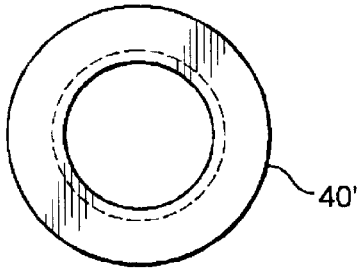
FIG. 12 is an end view of another structural component associated with the embodiment of FIG. 8.
Figure 13:
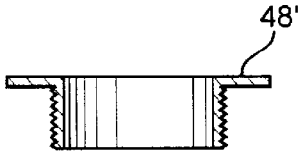
FIG. 13 is a cross sectional view of the embodiment of FIG. 12.
Figure 11:
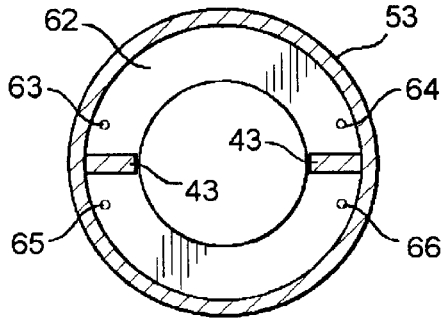
FIG. 11 is a sectional view of the embodiment of FIG. 8.
Figure 10:
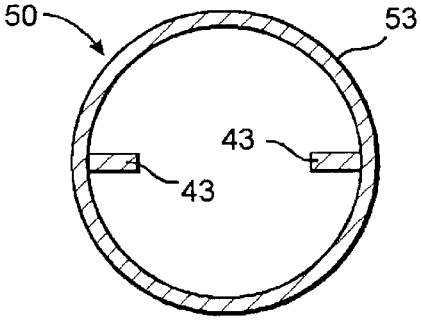
FIG. 10 is a sectional view of the embodiment of FIG. 8.
Figure 9:
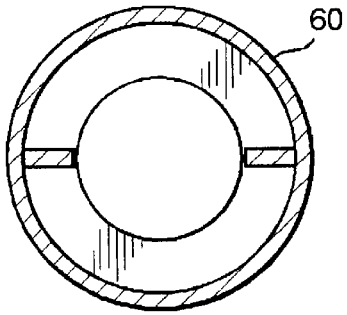
FIG. 9 is a sectional view of the embodiment of FIG. 8.

In the preferred embodiment, the primary foil 16 is structured to be selectively locked between the stored and operative positions. Preferably, the locking of the primary foil 16 in its operative position as shown in FIG. 1 or the selective removal of the primary foil 16 to its stored position, as at least partially indicated in FIG. 2, is accomplished by the selective manipulation of a latch assembly generally indicated as 24. The preferred latch assembly 24, as detailed in FIGS. 2, 4 and 7, includes a spring biased tongue member 26 mounted at least partially within an enclosing casing 28 which serves to house a biasing spring 29 therein. The distal end of the projecting tongue member 26 is designed to fit within or be removed from a receiving slot 30 secured to a proximal end 32 of an axle structure 34 shown in detail in FIG. 4 and coupled to the primary foil 16 as indicated subsequently. The biased tongue member 26 and enclosing casing 28 of the latch assembly 24 are preferably incorporated within a mounting housing as at 35, shown in greater detail in FIG. 7. The mounting housing 35 is integrally or otherwise fixedly secured to a hinge leaf 37 forming a part of a hinge assembly including a primary hinge 39. The opposite hinge leaf 40 is pivotally attached to the primary hinge 39 and is fixed or integrally attached to the proximal end 32 of the axle structure 34. It should be emphasized that the structural features of the latch assembly 24 as well as the cuff 12 could be effectively the same and/or the structural equivalents of the components of my previous invention as described in the above set forth patent.

With reference to FIGS. 3 through 13, other structural components of the present invention include the aforementioned axle structure 34. The axle structure 34 includes an elongated configuration terminating in a distal end as at 38 at which a retainer plate 40', having an annular configuration and used to facilitate secure interconnection between the axle structure 34 and the secondary foil 18, is attached. Furthermore, as previously recited, the proximal end 32 of the elongated axle structure 34 is preferably pivotally attached, by virtue of the primary hinge 39, to the cuff 12 or like structure for securing the entire apparatus to leg 14 of the swimmer. However, when fixed in the operative position, the axle structure 34 is structured to move with the cuff 12 or like attachment structure so as to remain in a generally constant orientation relative to leg, but such that the continuously changing orientation of the leg 12 of the swimmer (See FIG. 17) serves to continuously vary the orientation of the axle structure 34 within the water.

In addition, the present invention contemplates a vane assembly shown in part in FIGS. 4, 6, and 8–11. The vane assembly includes at least one, but preferably a plurality of pressure vanes as at 42 extending outwardly from the cylindrically shaped axle body 44 of the axle structure 34. In the embodiments as shown in the noted Figures, the pressure vanes 42 are oppositely aligned and oriented in substantially co-planar relation to one another. However, the present invention contemplates different orientations of the pressure vanes 42 relative to the axle body 44 of axle structure 34 other than that shown in FIG. 6. The pressure vanes 42 have an elongated configuration and preferably extend along at least a major portion of the length of the axle body 44. Due to the integral or fixed attachment of each of the pressure vanes 42 to the axle body 44, the pressure vanes 42 will vary their orientation in the water with the change of position of the swimmer's leg as the leg travels through a continuous swimming stroke as shown in FIG. 17.

Figure 3:
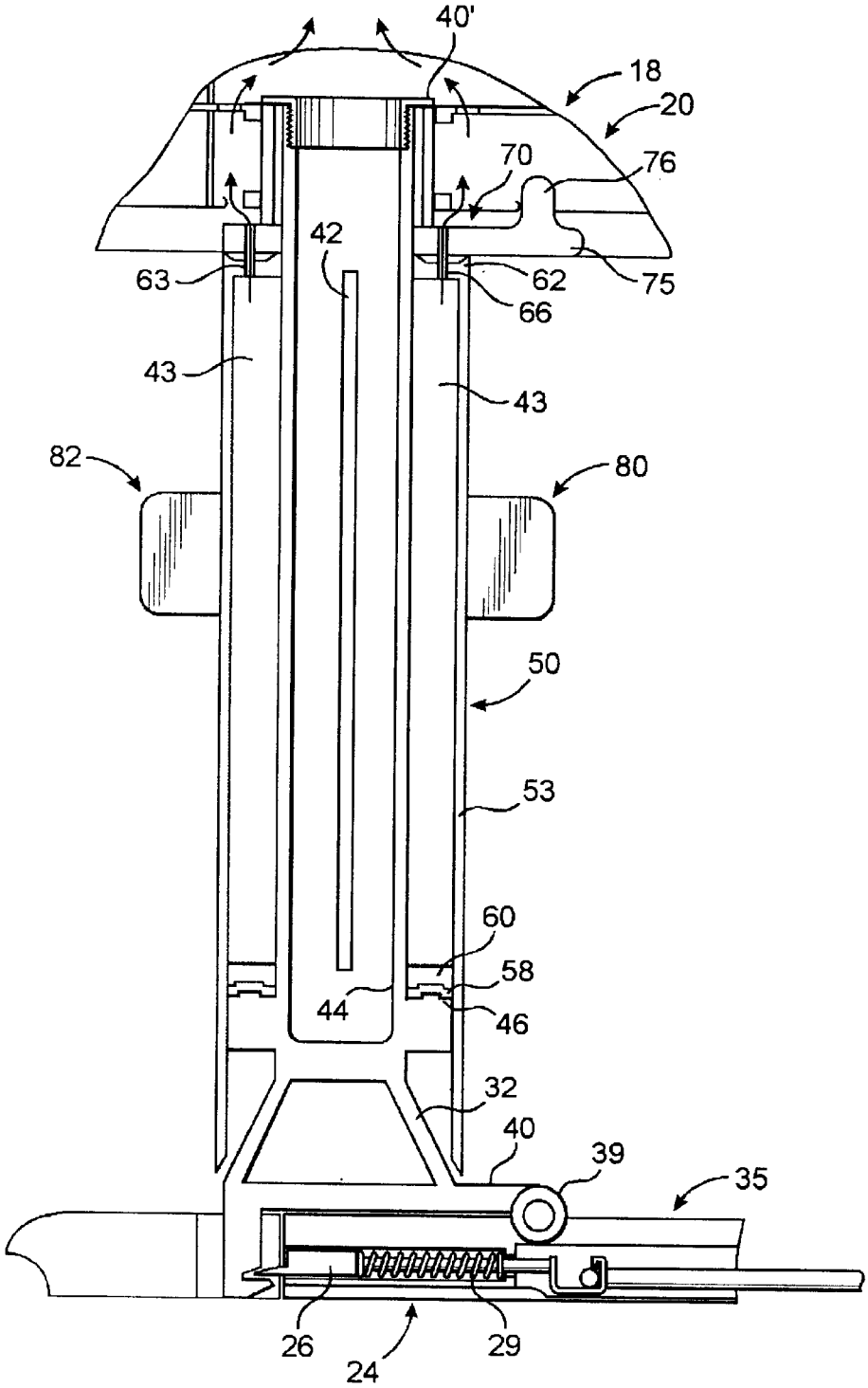
FIG. 3 is a detailed assembled view of the embodiments of FIGS. 1 and 2.

Mounted preferably in an interior of the primary foil 16 is a foil shroud 50. The foil shroud 50 is preferably disposed in secure, generally fluid tight, surrounding relation to a primary portion of the axle body 44 of the axle structure 34, and as such, functions to operatively dispose the primary foil 16 about the axle structure 34. In the preferred embodiment, a base portion 46 of the axle body 44 is preferably configured to facilitate the movable, yet generally fluid tight attachment of the foil shroud 50 shown in detail in FIGS. 8–11 on the axle structure 34. The foil shroud 50 is preferably fixedly secured with the primary foil 16 so as to move therewith in a pivotal or rotational manner relative to the leg cuff 12 and the leg 14 of the swimmer. More specifically, as also shown in FIGS. 14 and 18 through 20, the shroud 50 has an elongated configuration and includes a hollow interior portion as at 52 extending along at least a majority of the length thereof and defined by a generally cylindrical shroud body 53. The hollow interior portion 52 serves to at least partially define a control chamber dimensioned and configured to surround and effectively house the axle structure 34 as shown in FIG. 3.

The shroud body 53 further includes at least one but preferably a plurality of pressure control vanes 43 mounted on the interior thereof within control chamber 52. The pressure control vanes 43 are structured to extend radially inward in preferably aligned, substantially co-planar relation to one another. As a result, the aforementioned vane assembly is more specifically defined by the plurality of pressure vanes 42 and the plurality of pressure control vanes 43 all of which are mounted within the interior of the control chamber 52 defined between the elongated cylindrical shroud body 53 of the foil shroud 50 and the axle body 44 of the axle structure 34.

Figure 18:
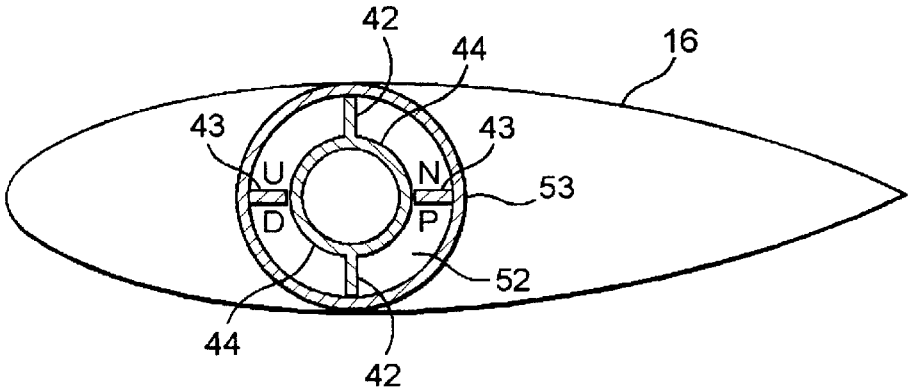
FIG. 18 is a schematic representation of certain structural components of the present invention.
Figure 19:
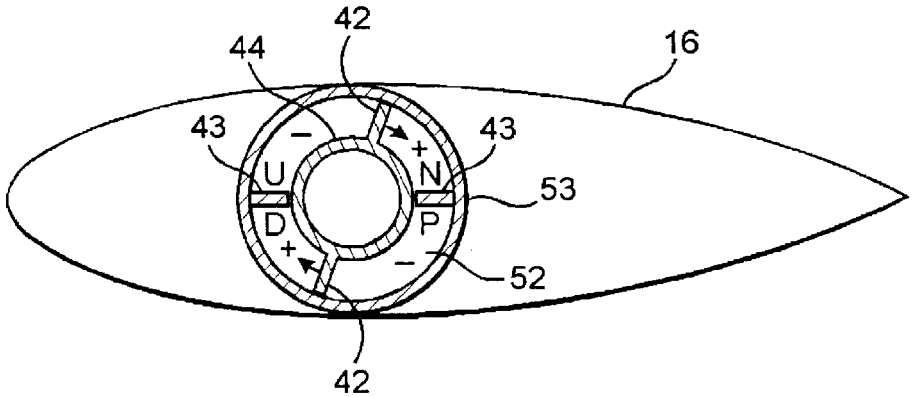
FIG. 19 is a schematic representation of certain structural features of the present invention.
Figure 20:
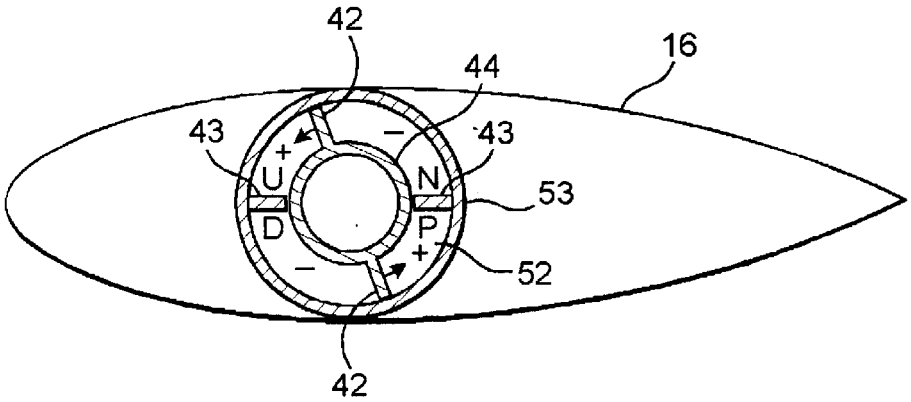
FIG. 20 is a schematic representation of certain structural features of the present invention.

Furthermore, the vane assembly defined by the plurality of pressure vanes 42 and the plurality of pressure control vanes 43 also collectively define a plurality of variable volume chamber segments, indicated in FIGS. 18 through 20 as U, N, P, and D, within the control chamber 52. As indicated, the pressure vanes 42 are fixedly secured to the axle body 44 of the axle structure 34 and are movable therewith, while the pressure control vanes 43 are fixedly secured to the shroud body 53 of foil shroud 50 and are movable therewith relative to the pressure vanes 42. In particular, the foil shroud 50, as a result of its secure interconnection with the primary foil 16, moves or more specifically rotates with the primary foil 16 about the axle body 44 and relative to the leg 14 of the swimmer. Conversely, the pressure vanes 42, as a result of their fixed attached to the axle body 44 of the axle structure 34 which is secured to the leg of the swimmer along with the cuff 12 or like attachment facility, move with the leg of the swimmer. Accordingly, the relative movement between the pressure vanes 42 and the pressure control vanes 43 functions to vary a volumetric dimension of the variable volume chamber segments U, N, P, and D within the control chamber 52 in direct relation to an orientation of the primary foil 16 relative to the leg 14 of the swimmer.

Figure 8:
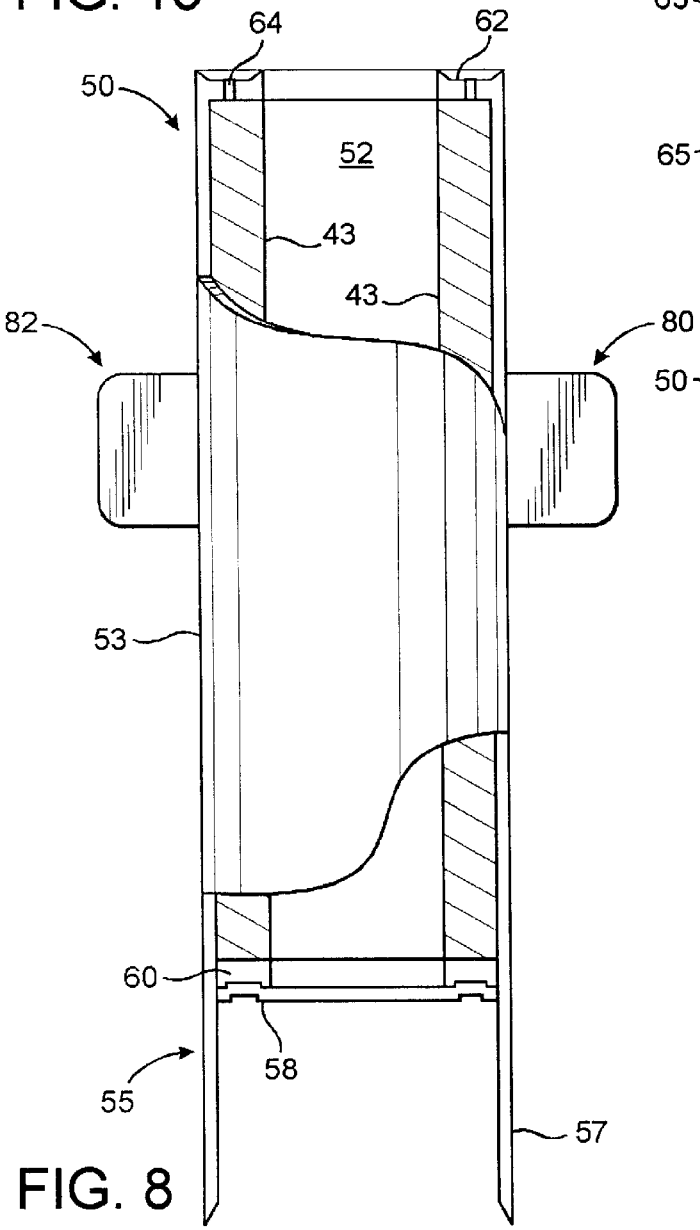
FIG. 8 is a detailed view in partial section and cutaway of additional structural features of the present invention.
Figure 14:
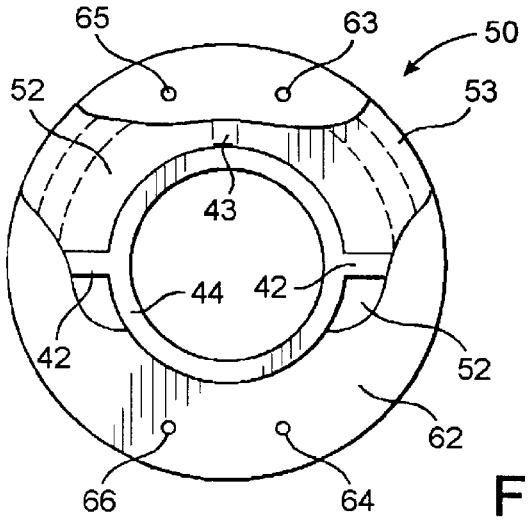
FIG. 14 is a detailed view in section of yet another feature of the present invention.
Figure 15:
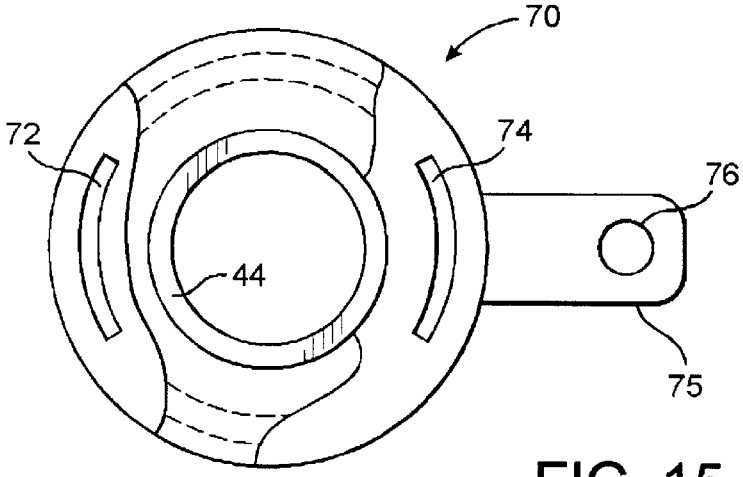
FIG. 15 is an end view in partial cutaway of another structural feature of the present invention.

In order to further define the variable volume chamber segments U, N, P and D, and generally enclose the control chamber 52, a base 55 of the shroud body 53 includes an annular skirt as at 57 disposed in surrounding relation to the conical base 32 of the axle structure 34, as shown in FIG. 8. Furthermore, a ring seal or gasket 58 is preferably disposed between a portion 60 of the shroud body 53 and the base portion 46 of the axle body 44. The opposite or distal end of the foil shroud 50 comprises an end plate 62 including a plurality of exit or relief ports 63, 64, 65 and 66. Each of these relief ports 63, 64, 65, and 66 is disposed in fluid communication with one of the aforementioned variable volume chamber segments U, N, P and D defined by the plurality of pressure vanes 42 and pressure control vanes 43, and function to define a plurality of fluid outlets from the control chamber 52. The relief ports 63, 64, 65 and 66, which pivot with the primary foil 16, further serve to at least partially define a flow control assembly which is specifically structured to regulate fluid or water flow through the interior of the control chamber 52 and in turn regulate the relative positions of the pressure vanes 42 and pressure control vanes 43, as will be described in greater detail subsequently. Along these lines additional relief ports and/or the variation of the specific dimension of the relief ports may be provided in order to provide more effective transitions at the top and bottom of the swimming stroke, and/or increased sensitivity in the angle of incidence adjustments to be described in greater detail subsequently. Of course, the relative positioning of these vanes within the control chamber 52 serve to define and/or regulate the orientation of the foil shroud 50 and the fixedly attached primary foil 16.

In particular, the flow control assembly is structured to be positioned, dependent upon the relative orientations of the secondary foil 20 and the primary foil 16 of the preferred embodiment, between an open position and a closed position, as to each of the variable volume chamber segments U, N, P and D. Indeed, the complete closing of all of the variable volume chamber segments U, N, P and D is generally not achieved. As can be expected, the open position is primarily structured to at least partially permit fluid to flow through a corresponding one or more of the relief ports 63, 64, 65, and 66, while the closed position at least partially restricts fluid flow through the corresponding one or more of the relief ports 63, 64, 65, and 66. Along these lines, in the preferred embodiment, the flow control assembly further includes a valve mechanism, such as the preferred valve plate generally indicated as 70 in FIG. 16. The valve plate 70 is preferably disposed in confronting relation to the relief ports 63, 64, 65, and 66 and includes two spaced apart arcuate openings as at 72 and 74. These arcuate openings each extend through an arc of substantially 60 degrees, and in their neutral position are disposed to extend at least 30 degrees on each side of the cord of the secondary foil 20, which defines a part of the attitude control assembly. The open position is generally defined as the alignment of one or more of the arcuate openings 72 and 74 of the valve plate 70 with a corresponding one or more of the relief ports 63, 64, 65, and 66, thereby allowing water flow from selected ones of the variable volume chamber segments U, N, P and D, to an exterior portion of the apparatus, through the attitude control assembly, as best shown in FIG. 3 and represented by the indicated directional arrows. An important feature of the valve plate 70 is the provision of an outwardly extending arm as at 75 including a mounting projection 76 formed thereon. The mounting projection 76 as well as the arm 75 is incorporated with the attitude control assembly 18 and more particularly is operatively coupled to the secondary foil 20 so as to move therewith. As set forth above, the surface configuration of the secondary foil 20 and the overall structure of the attitude control assembly 18 is such as to maintain substantially constant and continuous alignment of the attitude control assembly 18 with the relative direction of water flow 100 as shown in FIGS. 21 through 25. Therefore, any adjusted movement of the secondary foil 20 as the leg moves through the water and the direction of relative water flow changes will cause a rotation and/or re-orientation of the valve plate 70 relative to the end plate 62. This in turn will cause the arcuate openings 72 and 74 of the valve plate 70 to become either aligned or misaligned with the relief ports 63, 64, 65, and 66, which in turn defines the aforementioned flow control assembly being in either an opened or closed position, respectively, as to corresponding ones of the relief ports. Indeed, in this manner the secondary foil 20 maintains the reference line against which movement of the axle structure 34 and primary foil 16 operate. Moreover, the movement of the primary foil 16, and accordingly the relief ports, also serves to further enhance the variation of the aligned or misaligned orientations.

Figure 16:
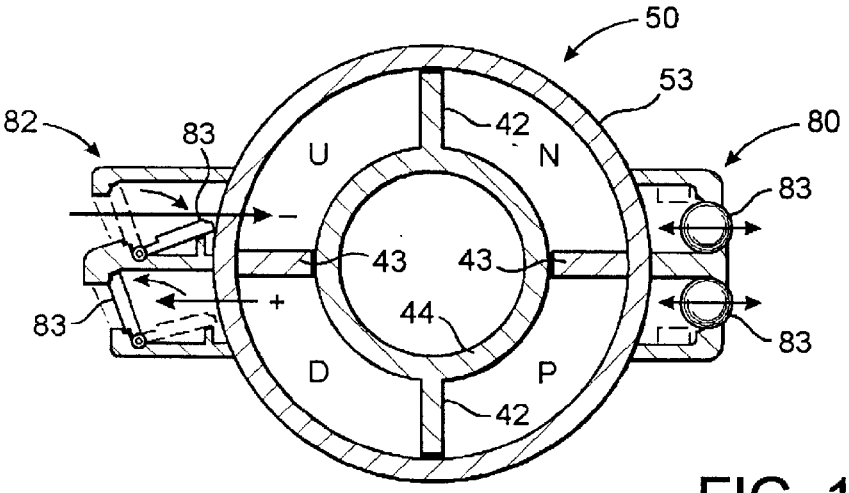
FIG. 16 is an end view in partial cutaway of another structural feature of one embodiment of the present invention.

The flow control assembly further includes at least one, but preferably a pair of fluid inlets 80 and 82. In the preferred embodiment, the fluid inlets 80 and 82 are more specifically defined by negative pressure relief and fill valves 83, the details of which are shown in FIG. 16. As such, the fluid inlets 80 and 82 of FIG. 16 each preferably include a pair of preferably one way check valves which define the pressure relief and fill valves 83 and will facilitate the in flow of water from the exterior of the primary foil 16 into one or more of the variable volume chamber segments, U, N, P, D upon a drop in fluid pressure within a respective variable volume chamber segment. For purposes of clarity, two embodiments of the check valves are illustrated, including a floating ball valve and a flap valve, however, any conventional valve assembly could be equivalently incorporated. Moreover, the opening and closing of such check valve is represented in the directional arrows associated with the illustrated pressure relief and fill valves 83.

Because of the aforementioned structure of the control chamber 52, the volume of the variable volume chamber segments, U, N, P, D expand and contract due to the relative movement of the pressure vanes 42 towards or away from adjacently positioned pressure control vanes 43. As such, an increase in size of one of the variable volume chamber segments will serve to open a corresponding one of the pressure relief and fill valves 83 and draw water in to fill the volume that results from the expansion of the appropriately positioned variable volume chamber segment. It is also noted, however, that when, in the preferred embodiment, an oppositely disposed pair of the variable volume chamber segments expand and are as a result "de-pressurized", a corresponding contraction and reduction of volume of adjacently positioned ones of the variable volume chamber segment also result. This contraction not only keeps the appropriate pressure relief and fill valve 83 closed, but also tends to "pressurize" the corresponding variable volume chamber segments and cause a pressure to be exerted on the appropriately positioned pressure control vane 43.

Accordingly, from the preceding, it should be apparent that water will flow into specific ones of the variable volume chamber segments U, N, P, D through the fluid inlets 80 and 82 defined by the pressure relief and fill valves 83. The flow of water is, however, further regulated by the previously described flow control assembly. In particular, when the flow control assembly is in the aforementioned and described open position, meaning that the arcuate openings 72 and/or 74 are in alignment with appropriate ones of the relief ports 63, 64, 65 and 66, water tends to flow out from the "pressurized" variable volume chamber segments permitting a further reduction in its volume as the corresponding pressure vanes 42 move towards the pressure control vanes 43. This action, relative to the position of the swimmer's leg during the performance of the conventional swimming stroke is described in detail with reference to FIG. 17–20. For example, in FIG. 17, a swimmer's leg is moving through an arc preferably of approximately 63 degrees as he performs a conventional swimming stroke. The axle structure 34 of the subject invention is fixed by the cuff 12, as described above, and accordingly moves therewith depending upon the relative position and orientation of the portion of the swimmer, preferably the leg, at which the cuff 12 is disposed, as the swimmer performs the swimming stroke. As such, the axle structure 34, having the two pressure vanes 42 fixed thereto and movable therewith is constantly changing the angular orientation of the pressure vanes 42 relative to the pressure control vanes 43 as the leg of the swimmer passes between a neutral position as shown in FIG. 18, through a down stroke position as shown in FIG. 19, and alternately through the up stroke position as shown in FIG. 20. This movement of the pressure vanes 42 towards the pressure control vanes 43 in turn tends to pressurizes the variable volume chamber segments. However with the relief ports 63, 64, 65 and 66 disposed in the open position, the fluid can escape from the variable volume chamber segments and a minimal force is exerted on the pressure control vanes 43, and accordingly the shroud body 53 and primary foil 16. Conversely, when either of the relief ports 63 and 66 or 64 and 65 are disposed in the closed position, the corresponding variable volume chamber segments are pressurized, and a pivoting pressure is exerted on the pressure control vanes 43 now locking the primary foil 16.

Specifically, the movement of the swimmer's leg 12 from the neutral position represented in FIG. 18 to the down stroke position represented in FIG. 19 causes the axle body 44, as well as the pressure vanes 42 secured thereto, to change the angular orientation from that of the neutral or mid-stroke position of FIG. 18 and move in a generally clockwise rotation, as illustrated in the figures. Since the primary foil 16 and shroud body 53 do not normally rotate in the same direction, as the pressure vanes 42 move towards adjacently positioned pressure control vanes 43, in accordance with directional arrows of FIG. 19, pressure will at lest temporarily be created within the variable volume chamber segments D and N. Accordingly, as the swimmer's leg 12 is moved, the pressure vanes 42 change angle in one direction forcing the shroud body 53 as well as the primary foil 16 attached there to pivot in the same direction in response to the water pressure exerted thereon by the decrease in the volume of the variable volume chamber segments D and N. Indeed, if the internal pressure in variable volume chamber segments D and N is not released, the foil shroud body 53, as well as the primary foil 16, will generally maintain its orientation relative to the axle body 44 on the down stroke. A further explanation of the results of this condition will follow. With regard to FIG. 20, the same condition is present with the leg moving along its up stroke position. The variable volume chamber segments U and P are now at least temporarily pressurized due to the change in direction of the travel of the pressure vanes 42, which, as set forth above, are secured to and rotate with the axle body 44 in a generally counter clockwise direction as represented in the Figures. In FIGS. 19 and 20, the internal pressure is at least temporarily trapped within variable volume chamber segments D and N on the down stroke and at least temporarily trapped within variable volume chamber segments U and P on the up stroke. If the pressure within these respective variable volume chamber segments is not released, the primary foil 16 will basically follow the swimmer's leg because it is then "locked" to the axle body 44.

Of course, due to the flow control assembly, the "locked" relation is only temporary and a constant modulation takes place. Specifically, the modulated and/or temporary relief of pressure within the "pressurized" variable volume chamber segments D and N in the down stroke and variable volume chamber segments U and P in the up stroke occurs as a result of the attitude control assembly, and in the preferred embodiment, when the secondary foil 20 of the attitude control assembly, which is structured to be continuously aligned with the direction of relative water flow 100 and the primary foil 16 rotate relative to one another. In particular, the relative orientations of the secondary foil 20 and primary foil 16 will cause the flow control assembly and particularly the arcuate openings 72 and 74 defined in the valve plate 70 to move relative to the corresponding relief ports 63, 64, 65 and 66 that communicate respectively with each of the variable volume chamber segments, U, P, D, N. As a result, and as best seen with reference to FIGS. 21–25, the automatic positioning and constant regulation of the primary foil 16 so that it is always in a predetermined, optimum angle of incidence relative to the direction of relative water flow 100 is maintained, and a maximum thrust generating condition is maintained.

Figure 21:
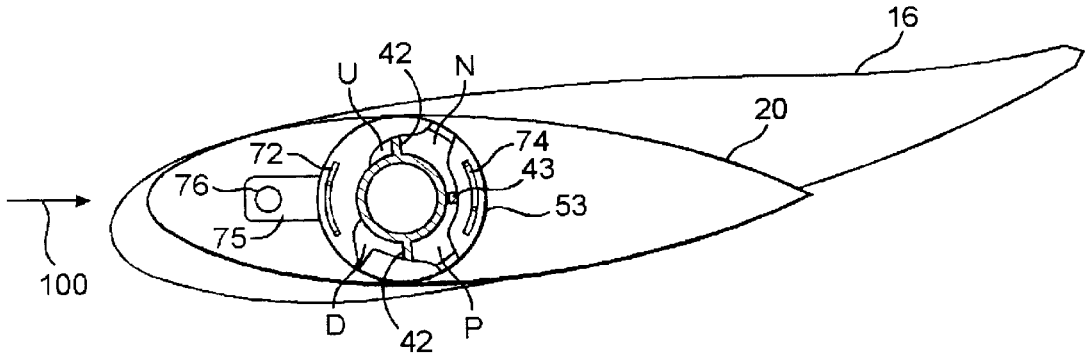
FIG. 21 is a composite view in partial cutaway of structural components of the present invention.
Figure 22:
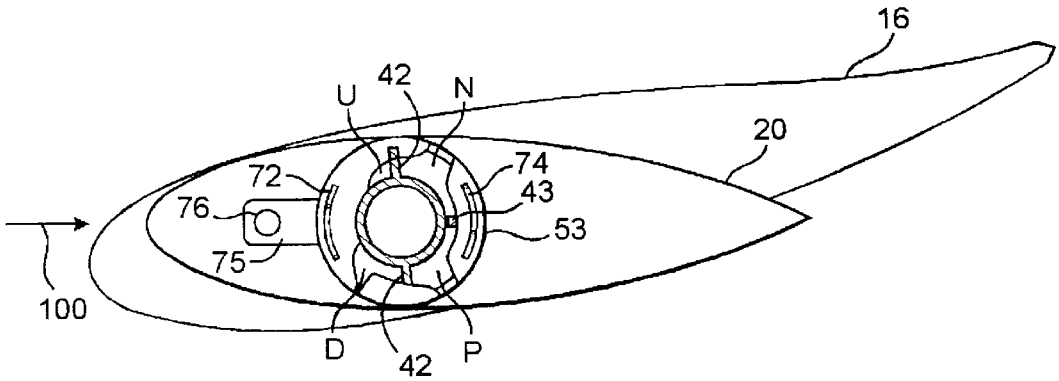
FIG. 22 is an end view in partial cutaway of the embodiment of FIG. 21 in a different position.
Figure 23:
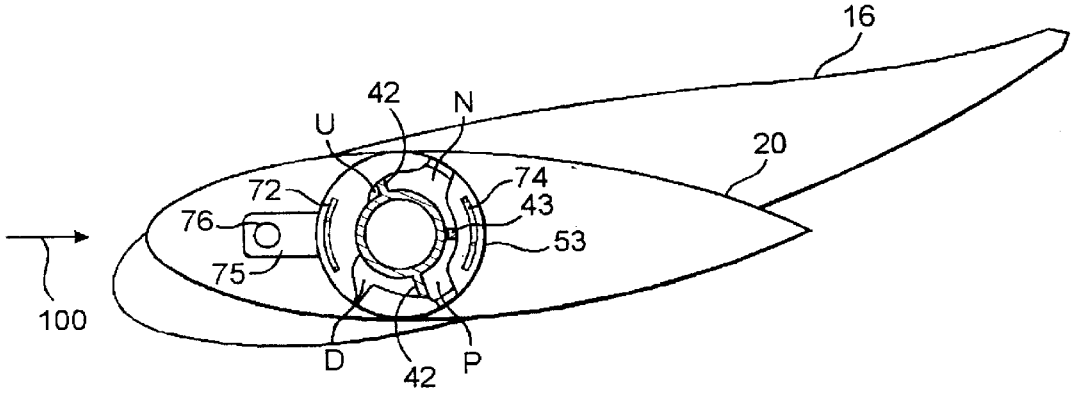
FIG. 23 is an end view in partial cutaway of the embodiment of FIG. 21 in a different position.

Specifically, in FIG. 21 the swimmer's leg has just moved into the down stroke from the top of its up stroke wherein the primary foil 16 has just moved from a nose up orientation, as was the case in during the up stroke, into a nose down orientation to assume the preferred, optimum angle of incidence. At that point water immediately rushes into the variable volume chamber segments U and P, and out of the variable volume chamber segments D and N. Indeed, an increase in the dimension and/or quantity of the relief ports may be warranted to aid this transition from nose up to nose down, or visa versa. As the down stroke continues, the positioning of the valve plate 70 is such that the relief ports corresponding variable volume chamber segments U and P are always open, while the relief ports corresponding variable volume chamber segments D and N constantly modulate between the open and closed position. Specifically, during the down stroke the natural tendency of the primary foil 16 moving through the water in its nose down angle of incidence and generating thrust under a load is for the nose to pivot further downward. As the nose of the primary foil 16 pivots downward, however, eventually the primary foil's 16 orientation relative to the secondary foil's 20 will be such that the relief ports corresponding to variable volume chamber segments D and N become covered, as in FIG. 23, and variable volume chamber segments D and N can no longer compress to permit further nose down pivoting and the primary foil 16 locks on the axle body 44. Now with the primary foil 16 locked and not pivoting on the axle body 44, the primary foil 16 will follow the leg and it's foil angle will decrease (nose up) allowing the primary foil 16 to re-orient the overall assembly until the relief ports corresponding variable volume chamber segments D and N become uncovered, as in FIG. 22. Specifically, the secondary foil 20 and as a result the valve plate 70 move as the secondary foil 20 maintains is reference alignment with the direction of relative water flow, the axle body 44 is reoriented with movement of the leg and re-orients the pressure vanes 42 accordingly, and the primary foil 16 re-orients the position of the relief ports and pressure control vanes 43. As such, at that point, water can escape variable volume chamber segments D and N and the primary foil 16 can continue to pivot until this movement once again covers the corresponding relief ports and the cycle begins again. Indeed, this constant opening and closing and re-orientation of the primary foil 16 continues throughout the down stroke resulting in continued minor adjustments to the angle of incidence of the primary foil 16, and generally maintaining the angle of incidence of the primary foil 16 at its preferred, optimum angle of incidence of approximately minus 15 degrees relative to the direction of water flow 100.

Figure 24:
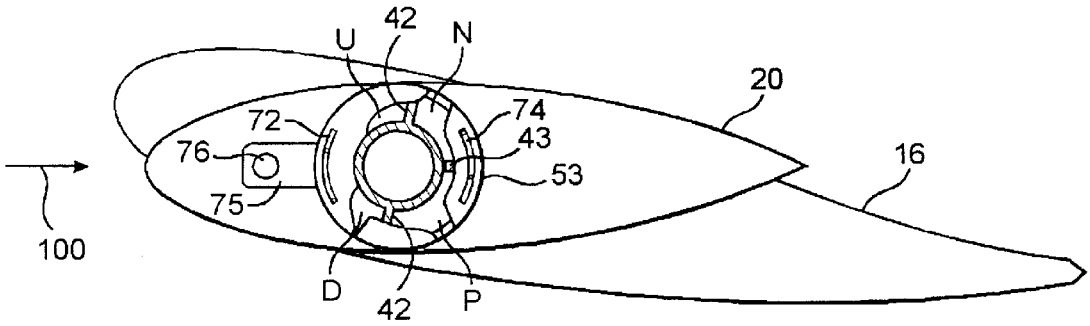
FIG. 24 is an end view in partial cutaway of the embodiment of FIG. 21 is a different position.
Figure 25:
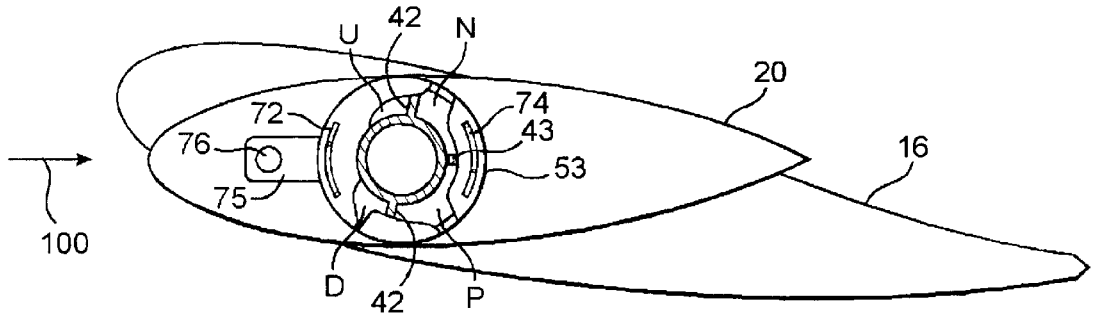
FIG. 25 is an end view in partial cutaway of yet another position of the position of the embodiment of FIG. 21.

With regard to FIGS. 24 and 25, an illustration of an up stroke segment is illustrated. Specifically, when the swimmer's leg reaches the bottom of the down stroke and begins the up stroke, an opposite immediate transition takes place as the nose of the primary foil 16 pivots rapidly from a nose down posture into a nose up posture which is more effective for generating thrust in the up stroke. As the up stroke continues, the natural tendency of the primary foil 16, which is generating thrust and is under load, is to pivot its nose up and become aligned with the direction of relative water flow. As this pivoting begins, however, the primary foil 16 reaches a point wherein the relief ports corresponding variable volume chamber segments U and P become covered, as in FIG. 24, pressurizing the variable volume chamber segments U and P and restricting further pivoting towards the nose up posture. Of course, the continued movement in the upstroke causes the now locked primary foil 16 to decrease it's angle nose down and re-orients the relative positions the primary foil 16 and the secondary foil 20, such that the relief ports corresponding variable volume chamber segments U and P become at least partially uncovered, as in FIG. 25, thus freeing the primary foil for at least a slight movement toward the nose up until such movement causes the corresponding relief ports become closed once again. This constant opening and closing serves to continuously update the orientation of the primary foil 16 so that is will generally maintain its preferred, optimum angle of incidence of approximately plus 15 degrees relative to the direction of water flow 100.

Based on the above, it should be apparent that the preferred angle of incidence of the primary foil 16 is constantly being modulated between the "ports open foil angle" to the "ports closed angle". The primary foil 16 is thereby maintained in a narrow range of relative angles of incidence in its optimum orientation relative to the direction of water flow 100 to maintain the foil between the optimum angle of incidence of between plus or minus 15 degrees relative to the direction of water flow 100. It should apparent also that upon modification of certain structural components, the preferred angle of incidence may be altered as necessary and be other than the aforementioned plus or minus 15 degrees relative to the direction of relative water flow 100 based on other foil design configurations and/or the location of the relief ports 63, 64, 65 and 66.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An apparatus for aiding a swimmer to swim, said apparatus comprising:

a) a attachment assembly structured to be cooperatively secured to the swimmer;

b) a primary foil interconnected with said attachment assembly and rotatable relative thereto and to the swimmer, c) said primary foil including an outer surface structured to facilitate the generation of thrust during movement thereof in a fluid medium, and d) an attitude control assembly operatively associated with said primary foil and structured to substantially continuously regulate, in accord with a direction of relative fluid flow, an angle of incidence of said primary foil relative to a position of a portion of the swimmer at which the attachment assembly is disposed during a swimming stroke;

e) a control chamber disposed in said primary foil and including a flow control assembly structured to regulate fluid flow into and out of said control chamber.

2. An apparatus as in claim 1 wherein said attitude control assembly further comprises a secondary foil movably disposed relative to said primary foil and structured and configured to maintain a substantially constant alignment with a direction of relative water flow.

3. An apparatus as in claim 2 wherein said secondary foil is mounted in generally interconnected relation with said primary foil, and said attitude control assembly is further structured to regulate the angle of incidence of said primary foil dependent at least in part on the relative orientation between said primary foil and said secondary foil.

4. An apparatus as in claim 3 wherein said secondary foil is pivotally disposed generally adjacent a distal end of said primary foil so as to pivot relative thereto.

5. An apparatus as in claim 1 wherein said primary foil is selectively positionable between a stored position and an operative position, said stored position substantially defined by orientation of said primary foil in adjacent, substantially aligned relation to a length of the swimmer.

6. An apparatus as in claim 1 further comprising at least one fluid inlet and at least one fluid outlet disposed in communicating relation with said control chamber and being respectively structured to regulate fluid flow into and out of said control chamber.

7. An apparatus as in claim 6 wherein said attitude control assembly is structured to regulate fluid flow into and out of said control chamber dependent at least in part on the relative orientation of said attitude control assembly and said primary foil.

8. An assembly as in claim 7 wherein said attitude control assembly comprises a secondary foil movably mounted relative to said primary foil; fluid flow into and out of said control chamber being determined by relative orientations of said primary foil and said secondary foil.

9. An apparatus as in claim 8 further comprising a valve mechanism associated with said secondary foil and movable therewith, said valve mechanism disposed to regulate fluid flow from said control chamber through said fluid outlet dependent on the relative orientations of said primary foil and said secondary foil.

10. An apparatus as in claim 1 further comprising:

said control chamber operatively associated with said primary foil and structured to allow fluid flow therethrough, at least one fluid inlet and at least one fluid outlet disposed in communicating relation with said control chamber and respectively structured to regulate fluid flow into and out of said control chamber, and said attitude control assembly being cooperatively structured with said control chamber to at least partially regulate said fluid flow through said control chamber for regulation of said angle of incidence of said primary foil.

11. An apparatus as in claim 10 further comprising a vane assembly mounted within said control chamber, said vane assembly including at least one pressure vane movable relative to said primary foil and at least one pressure control vane movable with said primary foil, said pressure vane and said pressure control vane movable relative to one another and disposed and structured to define a plurality of variable volume chamber segments within said control chamber.

12. An assembly as in claim 11 wherein the volume within each of said variable volume chamber segments is dependent on the relative position of said pressure vane and said pressure control vane within said control chamber.

13. An assembly as in claim 12 wherein said pressure vane is interconnected to said attachment assembly and is movable therewith, and said pressure vane is further disposed and structured to be variably oriented within said control chamber and variably positioned relative to said pressure control vane dependent on an orientation of the portion of the swimmer at which the attachment assembly is disposed during the swimming stroke.

14. An apparatus as in claim 13 wherein movement of said pressure vane and said pressure control vane towards one another is restricted when said fluid outlet is in a closed position and are movable towards one another when said fluid outlet is in an open position.

15. An apparatus as in claim 14 wherein a nose of said primary foil tends to pivot towards a direction of the swimming stroke when said fluid outlet is in said open position.

16. An apparatus as in claim 15 wherein said attitude control assembly and said fluid outlet are cooperatively structured and disposed to repeatedly position said fluid outlet between said open position and said closed position so as to substantially maintain the angle of incidence of said primary foil within predetermined parameters.

17. An apparatus as in claim 16 wherein said attitude control assembly further comprises a secondary foil movably disposed relative to said primary foil and structured and configured to maintain a substantially constant alignment with the direction of relative water flow.

18. An apparatus as in claim 17 further comprising a valve mechanism associated with said secondary foil and movable therewith, said valve mechanism disposed to at least partially regulate fluid flow from said control chamber through said fluid outlet dependent on the relative orientations of said primary foil and said secondary foil.

19. An apparatus as in claim 1 wherein said attachment assembly includes a cuff secured to a leg of the swimmer.

20. An apparatus for aiding a swimmer to swim, said apparatus comprising:

a) an axle structure attachable in a substantially fixed orientation to a swimmer's leg and movable therewith during movement of the swimmer's leg during a swimming stroke, b) a primary foil configured to facilitate the generation of thrust during the swimming stroke and supportedly mounted on said axle structure, c) said primary foil structured to be movable with said axle structure and the swimmer's leg during the swimming stroke and movable relative thereto to assume a predetermined optimum angle of incidence relative to a direction of relative water flow, and d) an attitude control assembly operatively associated with said primary foil and structured to substantially continuously regulate an orientation of said primary foil so as to assume the predetermined optimum angle of incidence; and e) said attitude control assembly being structured to maintain a substantially constant alignment with the direction of relative fluid flow.

21. An apparatus as in claim 20 wherein said attitude control assembly comprises a secondary foil movable relative to said primary foil and configured to maintain the substantially constant alignment with the direction of relative water flow.

22. An apparatus as in claim 20 further comprising a control chamber associated with said primary foil and including a flow control assembly structured to regulate fluid flow into and out of said control chamber.

23. An apparatus as in claim 22 wherein said control chamber is cooperatively structured with said attitude control assembly to regulate the orientation of said primary foil and the angle of incidence thereof dependent at least in part on fluid flow through said control chamber.

24. An apparatus as in claim 23 further comprising a vane assembly movably mounted within said control chamber and structured to define a plurality of variable volume chamber segments therein.

25. An apparatus as in claim 24 wherein said flow control assembly is cooperatively structured with said attitude control assembly to correspondingly regulate fluid flow into and out of said plurality of variable volume chamber segments, and is positionable between a closed position and an open position relative to each of said plurality of variable volume chamber segments.

26. An apparatus as in claim 25 wherein the orientation of said primary foil is substantially fixed relative to the leg of the swimmer when a corresponding portion of said fluid control assembly is in said closed position and a nose of said primary foil tends to pivot towards a direction of the swimming stroke when said fluid control assembly is in said open position.

27. An apparatus as in claim 26 wherein said attitude control assembly and said fluid control assembly are cooperatively structured to repeatedly position said corresponding portion of said fluid control assembly between said open position and said closed position so as to substantially maintain the angle of incidence of said primary foil within predetermined parameters.

28. An apparatus as in claim 22 further comprising a foil shroud secured to said primary foil and movable therewith, said foil shroud including a hollow interior portion disposed and configured to at least partially define said control chamber.

29. An apparatus as in claim 28 wherein said foil shroud is disposed in substantially surrounding relation to said axle structure and is pivotable with said primary foil relative to said axle structure.

30. An apparatus as in claim 29 further comprising a vane assembly mounted within said control chamber and including a plurality of pressure control vanes secured to said foil shroud and movable therewith and a plurality of pressure vanes secured to said axle structure and movable therewith relative to said plurality of pressure control vanes, said plurality of pressure control vanes and said plurality of pressure vanes collectively defining a plurality of variable volume chamber segments within said control chamber.

31. An apparatus as in claim 30 wherein said flow control assembly is disposed in fluid communicating relation with each of said variable volume chamber segments and is correspondingly positionable between a closed position and an open position relative to each of said variable volume chamber segments.

32. An apparatus as in claim 31 wherein said pressure vanes and said pressure control vanes are not movable towards one another to compress a corresponding one of said variable volume chamber segments defined therebetween when said fluid control assembly is in said closed position relative to said corresponding one of said variable volume chamber segments, and are movable towards one another when said fluid control assembly is in said open position relative to said corresponding one of said variable volume chamber segments.

33. An apparatus as in claim 32 wherein the orientation of said primary foil is substantially fixed relative to the leg of the swimmer when a corresponding portion of said fluid control assembly is in said closed position and a nose of said primary foil tends to pivot towards a direction of the swimming stroke when said fluid control assembly is in said open position.

34. An apparatus as in claim 33 wherein said attitude control assembly and said fluid control assembly are cooperatively structured to repeatedly position a corresponding one of said fluid outlet between said open position and said closed position so as to substantially maintain the angle of incidence of said primary foil within predetermined parameters.

35. An apparatus for aiding a swimmer to swim, said apparatus comprising:

a) a attachment assembly structured to be cooperatively secured to the swimmer;

b) a primary foil interconnected with said attachment assembly and rotatable relative thereto and to the swimmer, c) said primary foil including an outer surface structured to facilitate the generation of thrust during movement thereof in a fluid medium, and d) an attitude control assembly operatively associated with said primary foil and structured to substantially continuously regulate, in accord with a direction of relative fluid flow, an angle of incidence of said primary foil relative to a position of a portion of the swimmer at which the attachment assembly is disposed during a swimming stroke; and e) said attitude control assembly being structured to maintain a substantially constant relative alignment to the direction of relative fluid flow.

* * * * *